US006426488B2

(12) United States Patent
Schielke

(10) Patent No.: US 6,426,488 B2
(45) Date of Patent: Jul. 30, 2002

(54) HEATER WITH ELECTRICAL HEATING ELEMENTS FOR WATERBEDS

(75) Inventor: Tasso Schielke, Oer-Erkenschwick (DE)

(73) Assignee: Vontana Industrie GmbH & Co. KG (DE)

( * ) Notice: Subject to any disclaimer, the term of this patent is extended or adjusted under 35 U.S.C. 154(b) by 0 days.

(21) Appl. No.: 09/826,658

(22) Filed: Apr. 5, 2001

(30) Foreign Application Priority Data

Apr. 10, 2000 (DE) ..... 100 17 816

(51) Int. Cl.[7] ..... H05B 1/02
(52) U.S. Cl. ..... 219/505; 219/528; 219/494
(58) Field of Search ..... 219/505, 504, 219/528, 535, 494, 497, 501; 307/117; 338/22 R, 225 C

(56) References Cited

U.S. PATENT DOCUMENTS

| | | | | | |
|---|---|---|---|---|---|
| 3,958,208 | A | * | 5/1976 | Blaha | 219/505 |
| 4,121,088 | A | * | 10/1978 | Doremus et al. | 219/201 |
| 4,506,259 | A | * | 3/1985 | Rhodes | 340/640 |
| 4,798,936 | A | * | 1/1989 | Johnson, Sr. | 219/217 |
| 5,081,339 | A | * | 1/1992 | Stine | 219/528 |
| 5,889,260 | A | * | 3/1999 | Golan et al. | 215/505 |

FOREIGN PATENT DOCUMENTS

| | | |
|---|---|---|
| DE | 36 17 679 A1 | 12/1987 |
| DE | 90 03 832 U2 | 9/1991 |
| DE | 41 02 880 A1 | 12/1991 |
| DE | 195 08 315 C1 | 5/1996 |
| DE | 197 11 522 A1 | 10/1998 |
| WO | WO 98/36664 | 8/1998 |

OTHER PUBLICATIONS

DIN EN 60335–2–66 (DIN= German Industrial Standards), 11 pages, (Feb. 1996).

"PTC–Thermistoren als selbstregelnde Heizelemente" by E. Andrich, Philips Technische Rundschau, pp. 192–200, 30., (1969/70).

* cited by examiner

*Primary Examiner*—Mark Paschall
(74) *Attorney, Agent, or Firm*—Renner, Kenner, Greive, Bobak, Taylor & Weber

(57) ABSTRACT

The invention relates to a heater (1) with electrical heating elements (15–18) for waterbeds (2), which is arranged between a bed frame (4) and a safety film (5), and which controls the temperature of a metal plate (11) placed under the safety film (5) of a waterbed core (9) lying thereupon, wherein the heating elements (15–18) are connected in a heat-conducting manner with the bottom side (11*a*) of the metal plate (11) in a flat casing (14) via a readily heat-conducting layer (27). The object of the invention is to provide a heater that consistently prevents the metal plate (11) from overheating, and ensures a reliable control of the waterbed core (9) at varying heat transmission conditions. This object is achieved according to the invention by having the heating elements consist of several current and heat conducting metal elements (15–18) held together non-positively and/or positively by current carrying coupling elements (25, 26), and NTC heating elements (19–24) clamped in between that generate heat when energized, and by designing the readily heat-conducting layer (27) between the bottom (11*a*) of the metal plate (11) and heating elements (15–24) as a bilaterally adhesive film layer (27) with good current insulating properties.

14 Claims, 7 Drawing Sheets

FIG. 2
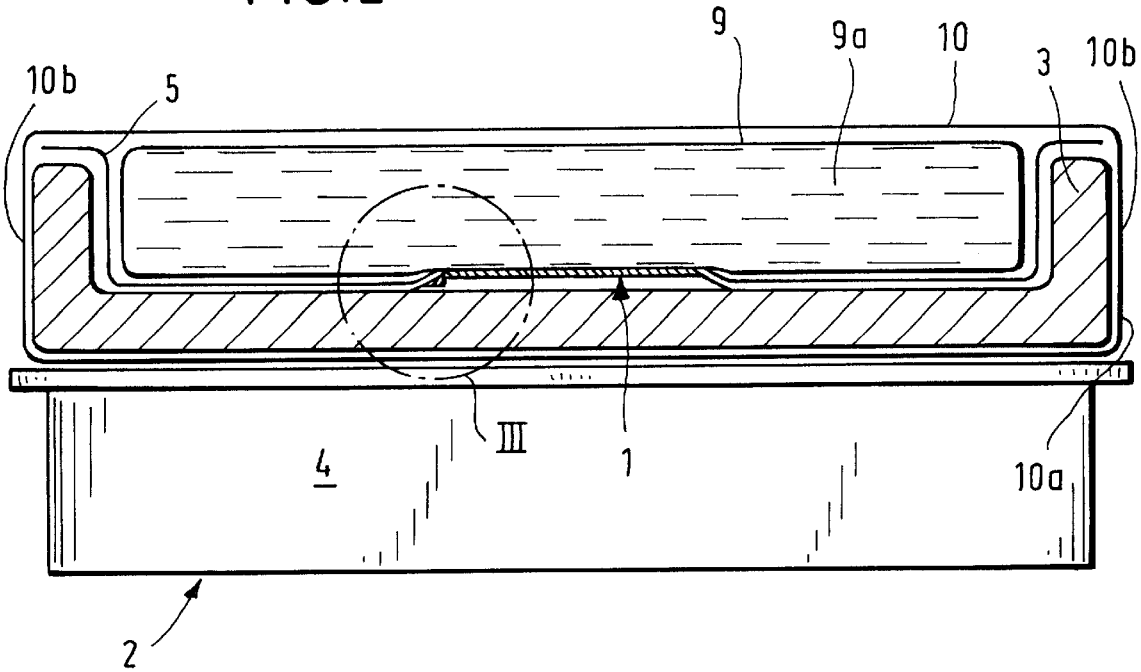
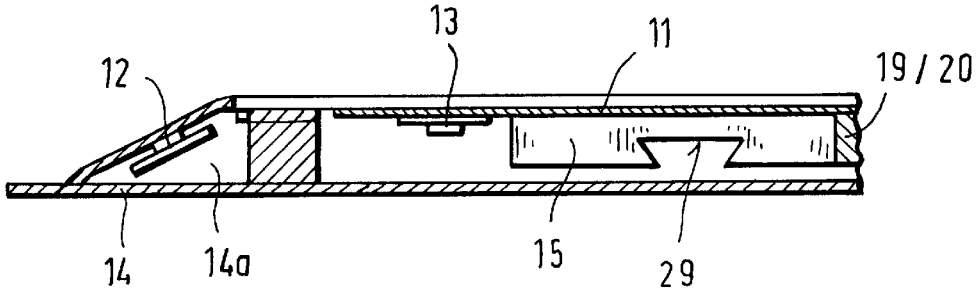
FIG. 3

HEATER WITH ELECTRICAL HEATING ELEMENTS FOR WATERBEDS

TECHNICAL FIELD

The invention relates to a heater with electrical heating elements for waterbeds, which is arranged between a bed frame and a safety film, and which controls the temperature of a metal plate placed under the safety film of a waterbed core lying thereupon, wherein the heating elements are connected in a heat-conducting manner with the bottom side of the metal plate in a flat casing via a readily heat-conducting layer.

BACKGROUND ART

In a heater of this kind according to DE 195 08 315 C1, the electrical heating elements consist of electrical conductors made out of a pasty mixture of noble metal particles, e.g., gold, silver or ruthenium, and ceramic constituents, such as glass and aluminum oxides, which are burned in as a hybrid conductor loop on a ceramic plate consisting of an aluminum oxide substrate. When carrying a current, these electrical conductors generate heat, which is conveyed to the metal plate of the casing of this heater via the ceramic plates as the heat conductors and via the readily heat-conducting layer. The ceramic plates here do not act as heat generators, but only as pure heat conductors of the heat generated by the electrically burnt-in resistance conductor loops when energized. To this end, the heat-conducting layer with which the ceramic plates are bonded to the bottom of the metal plate consists of an adhesive with high heat conductivity. An NTC sensor is arranged on the bottom of the deflection-resistant metal plate, while the current conductors leading to the burnt-in resistance wire conductors are connected with a TRIAC, which is also attached to the bottom of the metal plate. Both the NTC sensor and TRIAC are connected with a controller.

According to DIN-EN 60335-2-66 of February 1996, the temperature on the surface of a waterbed heater cannot exceed 60° C., while the temperature on the surface of the waterbed mattress cannot exceed 37° C. Further, the temperature increase on the surface of the waterbed heater cannot exceed 125° C.

The previously described waterbed heater according to DE 195 08 315 C1 cannot satisfy these requirements, since the NTC sensor is attached to the metal plate, as a result of which it only measures the metal plate temperature, and hence can only control the temperature of the metal plate. Such an NTC sensor operates according to the principle that its electrical resistance decreases as the temperature increases, and vice versa. As a consequence, a cable break causes the resistance to undergo an infinite increase, mistakenly indicating a low temperature, which relays the command to heat to the controller.

Further, this heater cannot accommodate various waterbed cores, i.e., waterbed cores with different volumes of water, frame composition (metal, foam or wood) and different covers, e.g., a covered and non-covered waterbed core, because the respectively differing heat radiation losses cannot be detected by the NTC sensor in light of the various aforementioned conditions. In this case, experience has shown that the temperature of the waterbed core deviates considerably form its desired control temperature. In addition, since the bottom of the metal plate is fitted with small ceramic plates as heat conductors, which take up only a small area of the metal plate, zones with highly disparate temperatures are present on the metal plate during the heating phase. As a result, its radiating surface exhibits a considerable temperature fluctuation. These temperature fluctuation is understood to mean temperature deviations on the surface of the metal plate in the form of temperature spikes directly above the ceramic conductor, and temperature valleys between the two ceramic conductors, which become evident in the heating phase.

In turn, this causes the NTC sensor to relay a temperature to the controller that does not coincide with the actual average temperature of the heating phase, but at most in the stationary state.

WO 98/36664 disclosed a waterbed heater in which a layer with a high electrical resistance is attached under the metal plate, and an electrical resistance wire heater thereupon, which is in turn shielded form the casing by a layer with a high electrical resistance. This heater has the same disadvantages as the one mentioned at the outset, specifically that the conductor loops can completely or partially tear given an undesirably high load and sag of the metal plate, which interrupts current conduction. This holds true all the more so since a layer of air or other dampening layer made out of soft material is frequently located between the electrical conductor loops and underlying casing floor for heat attenuation, facilitating a sag in the metal plate. A protective device that independently, and hence automatically, prevents the metal plate from overheating under all conditions given a failure of a control line leading to it can also not be encountered in this waterbed heater. This case involves no more and no less than a conventional resistance wire heater with all associated disadvantages that is known in numerous variations.

DISCLOSURE OF THE INVENTION

Proceeding from this most obvious prior art, the object of the invention is to provide a heater of the generic type mentioned at the outset, which, while avoiding the aforementioned disadvantages, consistently prevents the metal plate from overheating on the one hand, and ensures a reliable control of temperatures in the waterbed core at varying volumes of water for different frame compositions, whether metal, foam or wood, and given varying room temperatures and covers, and hence under different heat transmission conditions.

This object is achieved according to the invention in conjunction with the generic notion mentioned at the outset by having the heating elements consist of several current and heat conducting metal elements held together non-positively and/or positively by current carrying coupling elements, and NTC heating elements clamped in between that generate heat when energized, and by designing the readily heat-conducting layer between the bottom of the metal plate and heating elements as a bilaterally adhesive film layer with good current insulating properties.

For the first time, this design provides a waterbed heater with real ceramic heating elements, i.e., with those NTC heating elements that generate the desired heat directly when energized, and do not act simply as heat conductors of a burnt-in hybrid resistance conductor loop, as in prior art. Since the heating elements now consist of several current and heat conducting metal elements held together non-positively and/or positively by current carrying coupling elements, the entire bottom surface of the metal plate can be heated completely uniformly, without any noticeable fluctuations.

In addition, the NTC heating elements offer an automatic, and hence independently arising safety function, since its electrical resistance rises steeply at a temperature of 90° C., for example, and approaches infinity at a temperature of 100° C., so that the flow of current through the metal elements is interrupted, thereby precluding any overheating.

In an advantageous further development of the invention, the metal elements consist of aluminum or copper sections with a high mass, and hence a great storage capacity. The NTC heating element is advantageously made out of barium carbonate, titanium oxide and other additives, while the film layer consists of a permanently elastic heat conducting film filled with an acrylate adhesive.

The coupling element advantageously consists of a resilient contacting clamp, which non-positively, conductively and positively couples two balanced metal elements with the NTC heating elements lying in between. In this way, simple means are used to obtain an extremely compact overall heating element, which can do without any and all adhesive layers situated in between. To simplify the coupling of the contacting clamps, the side of the metal elements facing away from the current-insulating and heat insulating film are provided with dovetailed recesses for the positive engagement of contacting clamps.

In an advantageous further development of the invention, the heater has a total of four parallel running metal elements with a total of six NTC heating elements located in between, under the metal plate and film layer, as an overall heater.

In a particularly advantageous further development of the invention, the heater is controlled by two NTC sensor, of which a first is situated outside the area of the metal plate in an outside area of the casing in such a way as to be in direct measuring contact with the waterbed core, and a second is arranged under the metal plate in a known manner. As a result, the second NTC sensor always measures the temperature of the metal plate, and the first NTC sensor always measures the temperature of the waterbed core. Both NTC sensors are connected with a microcomputer, which continuously evaluates both temperatures, and controls the temperature of the metal plate in such a way that the water temperature of the waterbed core rises to a temperature adjustable with a controller. This ensures that the desired waterbed core temperature is not only always reached, but held constant, completely independent of the water volume level, the entirely different constitution of the waterbed frame, whether it consist of metal, foam or wood, and completely independent of the room temperature and cover states of the waterbed core. In this case, the microcomputer is set in such a way that the surface temperature of the metal plate does not exceed 60° C. In addition, a malfunction is precluded by the microcomputer via a plausibility check given a break in one or both NTC sensors or line leading thereto, and hence both the temperature of the metal plate surface and temperature of the waterbed core are limited to the values permitted under the DIN standard.

BRIEF DESCRIPTION OF THE DRAWINGS

The drawings show an embodiment of the invention. Shown on:

FIG. 2 is the transverse section through a waterbed with a heater according to FIG. 1 lying between the cushion of the bed frame and safety film.

FIG. 3 is a magnified section III of FIG. 2 of a side area of the watered heater.

PREFERRED EMBODIMENT FOR CARRYING OUT THE INVENTION

Figure 1:
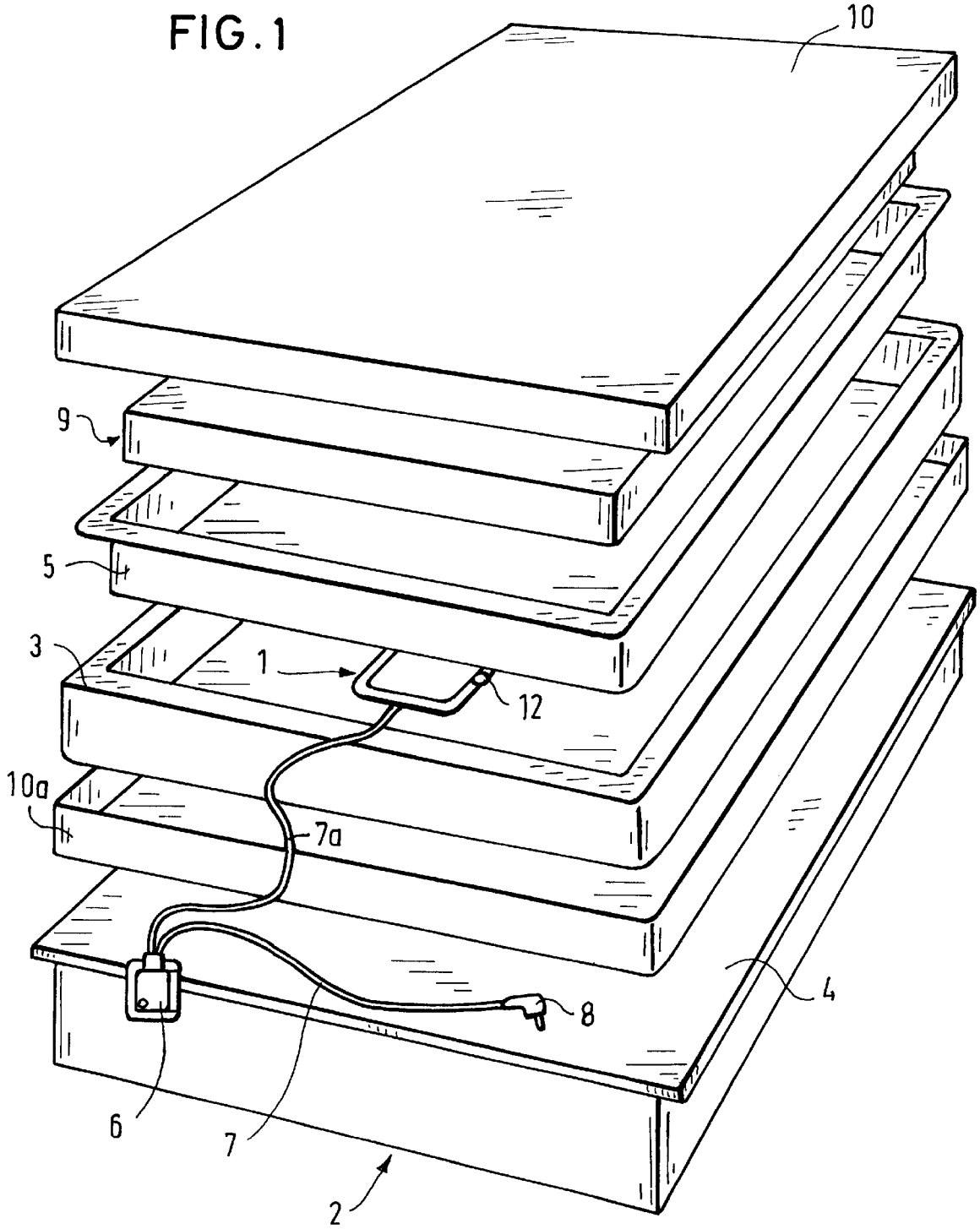
FIG. 1 is a perspective exploded view of a waterbed, with a heater arranged between a cushion of the bed frame and the safety film.

According to FIGS. 1 and 2, the new heater 1 for a waterbed 2 is arranged between a cushion 3 of a bed frame 4, which can consist of metal, plastic or wood, and a safety film 5. The waterbed heater controller is marked 6, the flexible conductor cables are marked 7 and 7*a,* and the plug is marked 8. The waterbed core 9 is placed on the safety film 5 laid out in the form of a trough. The trough-shaped safety film 5 is intended to catch the entire water content of the waterbed core 9 should it develop a leak. The watered core 9, safety film 5 and cushion 3 are encased by an upper cover part 10, which is connected with a lower cover part 10*a* of the cover 10, 10*a* by means of a circumferential zipper at 10*b* (not shown) (see FIG. 2).

Parts on FIG. 2 that coincide with those on FIG. 1 are marked with the same reference numbers. The water 9*a* in the waterbed core 9 is to be heated to the desired temperature by the waterbed heater 1. This water 9*a* is subject to completely variable heat losses owing to radiation and heat conduction, depending on whether or not a blanket is present on the upper cover part 10, for example, or depending on whether the frame 4 is made out of wood, metal or foam. All previously known waterbed heaters measure the temperature of the metal plate 11 only with an NTC sensor 13 attached to the metal plate 11. As a result, such an NTC sensor 13 can only control the temperature of this metal plate 11. This NTC sensor 13 can have no influence on the varying radiation and heat dissipation losses of the water 9*a* inside the waterbed core 9.

Figure 4:
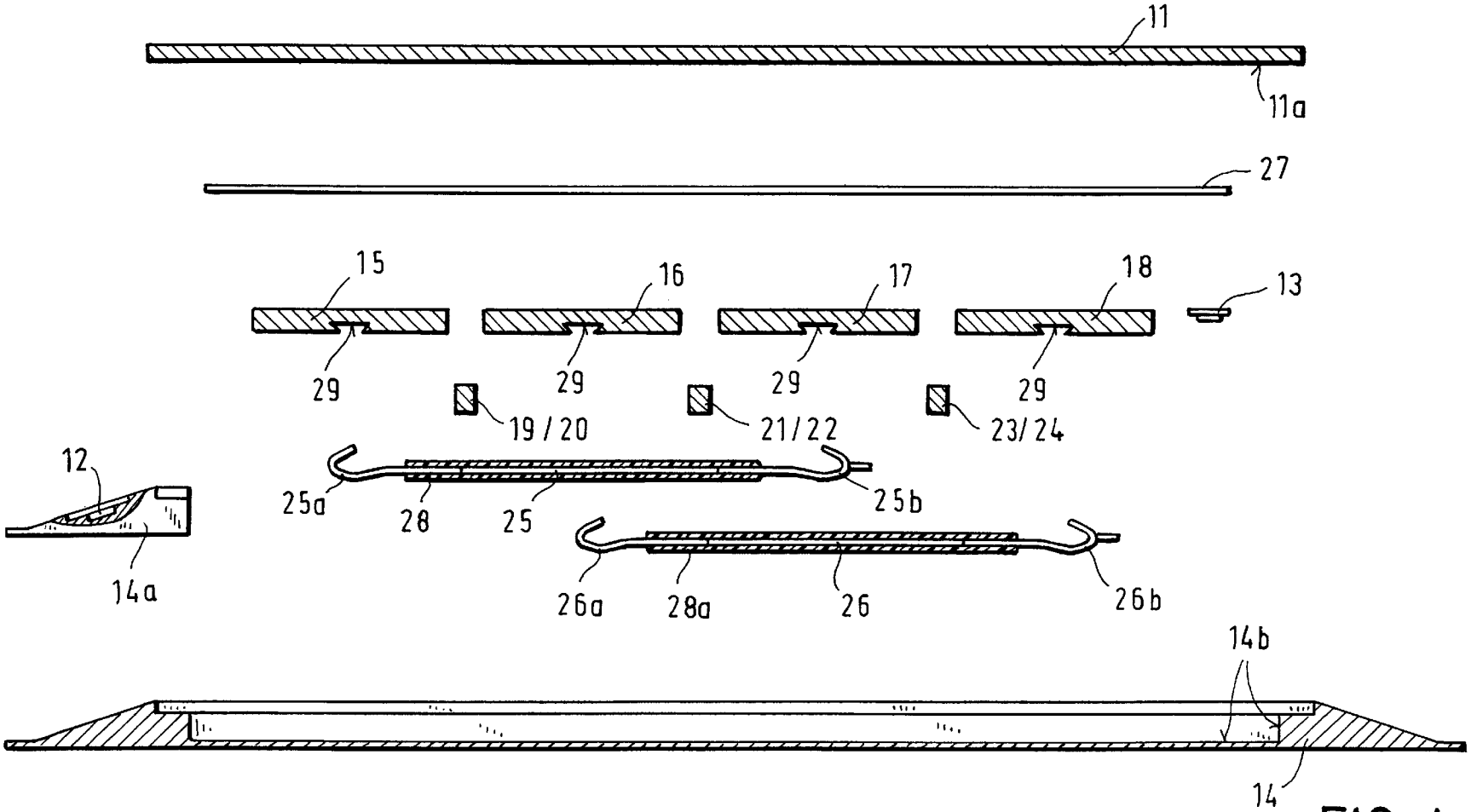
FIG. 4 is an exploded view of the heater comprised of the metal plate, metal elements with NTC heating elements lying in between, and coupling elements.

According to FIG. 4, the heater 1 according to the invention consists, from bottom to top, of a readily heat dampening plastic casing 14 which, if possible, reflects the downwardly directed heat toward the top via a coating 14*b,* e.g., comprised of aluminum or a vacuum evaporated chromium layer, four metal elements 15–18 comprised of extruded aluminum or copper sections, a total of six NTC heating elements 19–24 that generate heat when energized, which are held together in a positive and conductive manner by current-carrying coupling elements 25, 26. In addition, the heater 1 encompasses a readily heat-conducting and current-insulating layer 27, which is arranged between the bottom 11*a* of the metal plate 11 and the metal elements 15–18 and the NTC heating elements 19–24. The middle section of coupling elements 25, 26 is either partially or completely encapsulated by a current-insulating layer 28, 28*a,* so that, of the two coupling elements, the respective metal element 16 or 17 lying between the ends 25*a,* 25*b* of the coupling element 25 and the ends 26*a,* 26*b* of the coupling element 26 has no current contact with the coupling elements 25, 26 in this area in order to avoid a short circuit, with only the balanced metal elements 15 and 17 on the one hand, and 16 and 18 on the other having this current contact.

According to FIGS. 3 and 4, the heater 1 is controlled by two NTC sensors 12, 13, of which the first 12 is arranged outside the area of the metal plate 11 in an outside area 14a of the casing 14 in such a way as to be in direct measuring contact with the waterbed core 9 via the safety film 5, while a second NTC sensor 13 is in measuring contact with the bottom 11 a of the metal plate 11 via the film 27 in a known manner. Both the metal elements 15–18 and the six NTC heating elements 19–24 are non-positively, positively and conductively held together with the coupling elements 25, 26, which are designed like a leaf spring at least at their ends 25*a*, 25*b* or 26*a*, 26*b*. To this end, the ends 25*a*, 25*b* or 26*a*, 26*b* non-positively and positively engage cross-sectionally dovetailed grooves 29 of the metal elements 15–18. As a result, adhesives or other fastening means need not be used to achieve an outstanding heat transfer from the NTC heating elements 19–24 that generate heat when energized to the metal elements 15–18.

Figure 6:
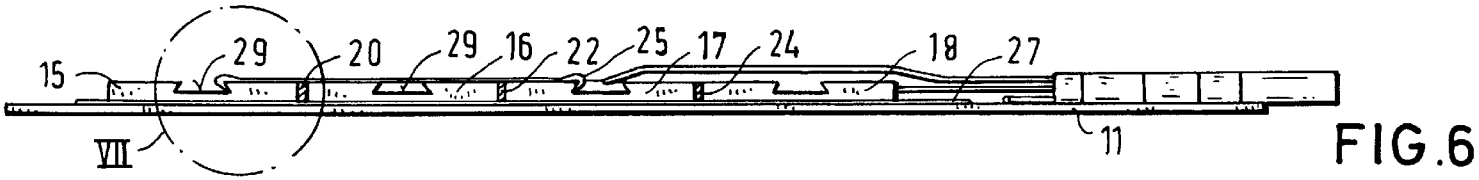
FIG. 6 is a side view along the VI—VI line from FIG. 5.
Figure 5:
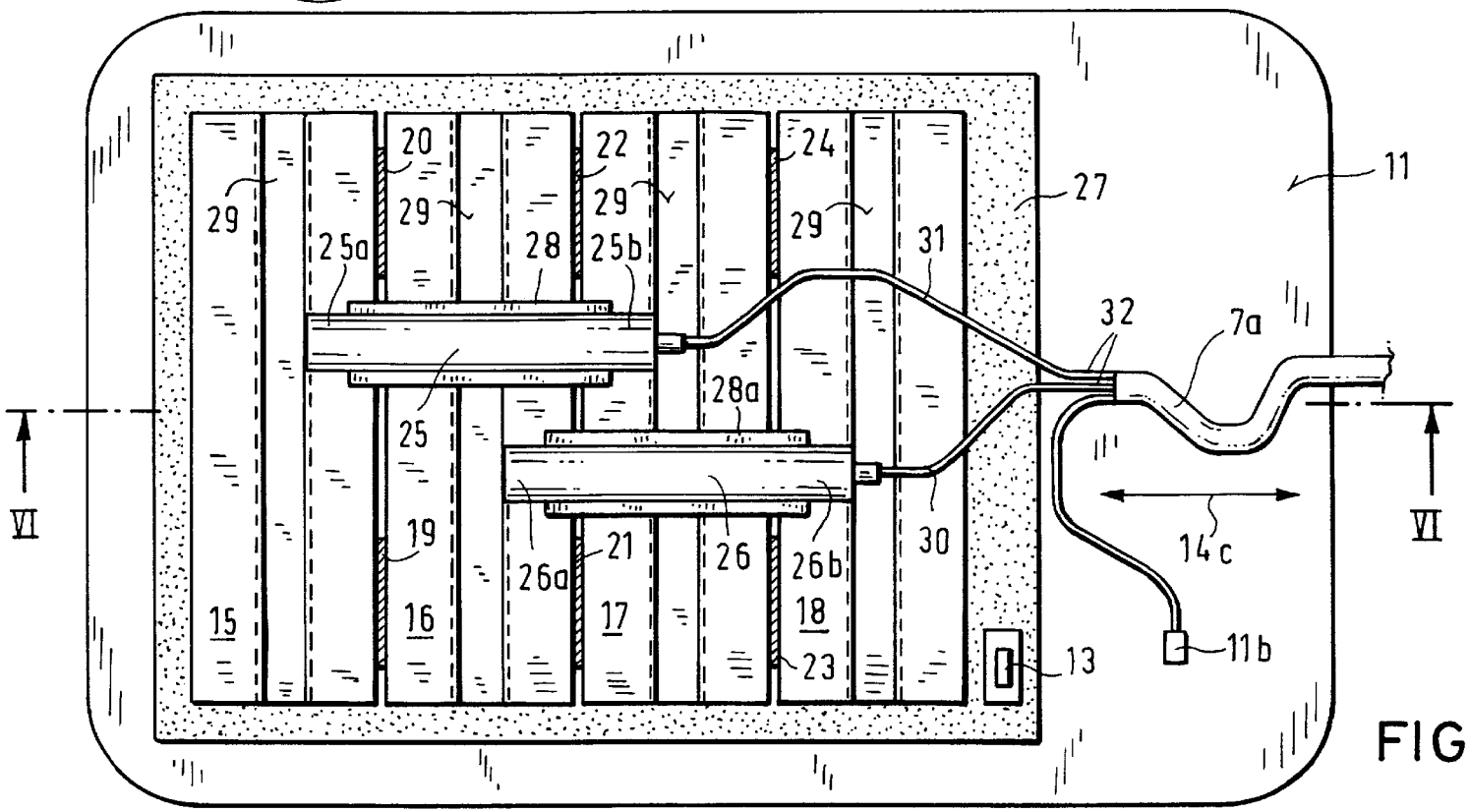
FIG. 5 is a view from below the heater with casing removed.

FIGS. 5 and 6 show the heater 1 according to FIG. 4 as assembled with the casing 14 removed. In this case, parts corresponding to those on FIG. 4 are marked with the same reference numbers. Shown under the metal plate 11 on FIGS. 5 and 6 are a strain relief area 14*c* and power cable 7*a*, as well as a ground connection 11*b* for the metal plate 11. Parts corresponding to those on FIG. 4 are marked with the same reference numbers. This also holds true for FIG. 7.

Figure 7:
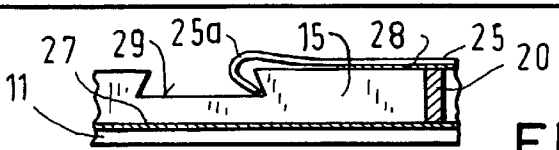
FIG. 7 is a magnified section VII from FIG. 6.

FIG. 7 illustrates how the ends 25*a*, 25*b* along with ends 26*a*, 26*b* of the coupling elements 25, 26 resemble leaf springs, and also demonstrates that, once these ends 25*a*, 25*b*, 26*a*, 26*b* have been flipped back into the dovetailed grooves 29 in the metal elements 15–18, spontaneous detachment is no longer possible. When the ends 25*a*, 25*b* of the coupling element 25 are spring-pretensioned, and the ends 26*a*, 26*b* of the coupling element 26 are correspondingly pretensioned, both the metal elements 15–18 and the NTC heating elements 19–24 are connected with the appropriate force, and hence in a readily heat and current conducting manner.

Figure 8:
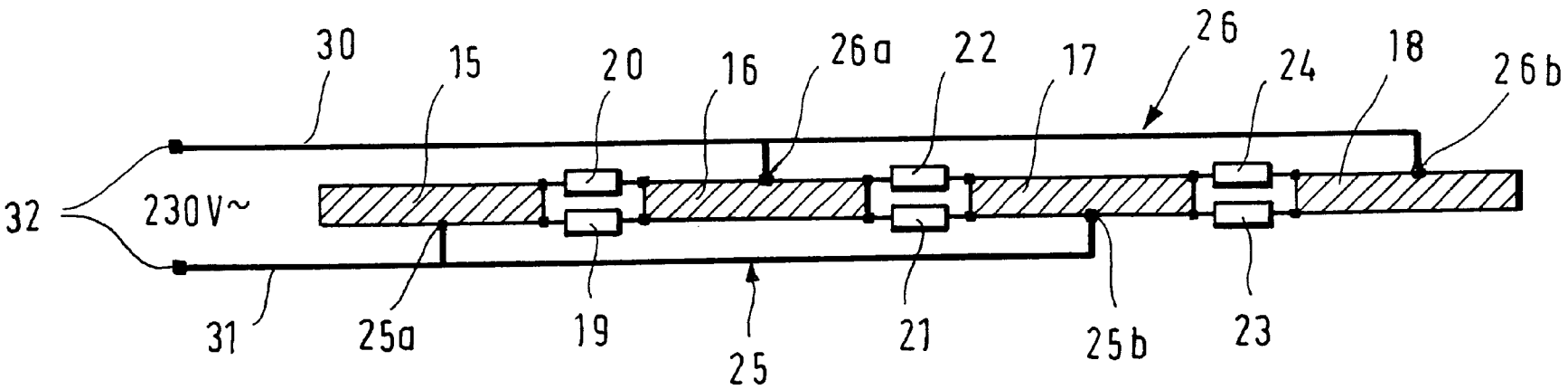
FIG. 8 is an equivalent circuit diagram of the heater from FIG. 4 and 5.

FIG. 8 shows an equivalent circuit diagram of the heater 1 on FIGS. 4 and 5. Matching parts on these figures are marked with the same reference numbers. A current path 30 is conductively connected with the coupling element 26, while another current path 31 is conductively connected with the coupling element 25.

The alternating current flows along the current path 30 in both directions via the end 26*a* of the coupling element 26 into the metal element 16, through the two NTC heating elements 19, 20, into the metal element 15, and from there into the current path 31 via the end 25*a* of the coupling element 25.

The alternating current again flows along current path 30 and coupling element 26 via its end 26*b* into the metal element 18, from there through the two NTC heating elements 23, 24 into the metal element 17, and from there via the end 25*b* of the coupling element 25 into the current path 31.

Finally, current flows along the current path 30, the end 26*a* of the coupling element 26 into the metal element 16, from there through the two NTC heating elements 21, 22 into the metal element, and from there via the end 25*b* of the coupling element 25 into the current path 31.

As a result, when an alternating current is applied to the ends 32 of the current paths 30, 31, all NTC heating elements 19–24 carry the alternating current via the coupling elements 25, 26 and metal elements 15–18 in both directions of the described current continuities. The heat generation and achievable temperature level depends on the composition of the NTC heating elements 19–24, which consist of barium carbonate, titanium oxide and other additives. Depending on composition, the NTC heating element 19–24 can increase its electrical resistance relative to the current flow starting at a specific temperature.

Figure 9:
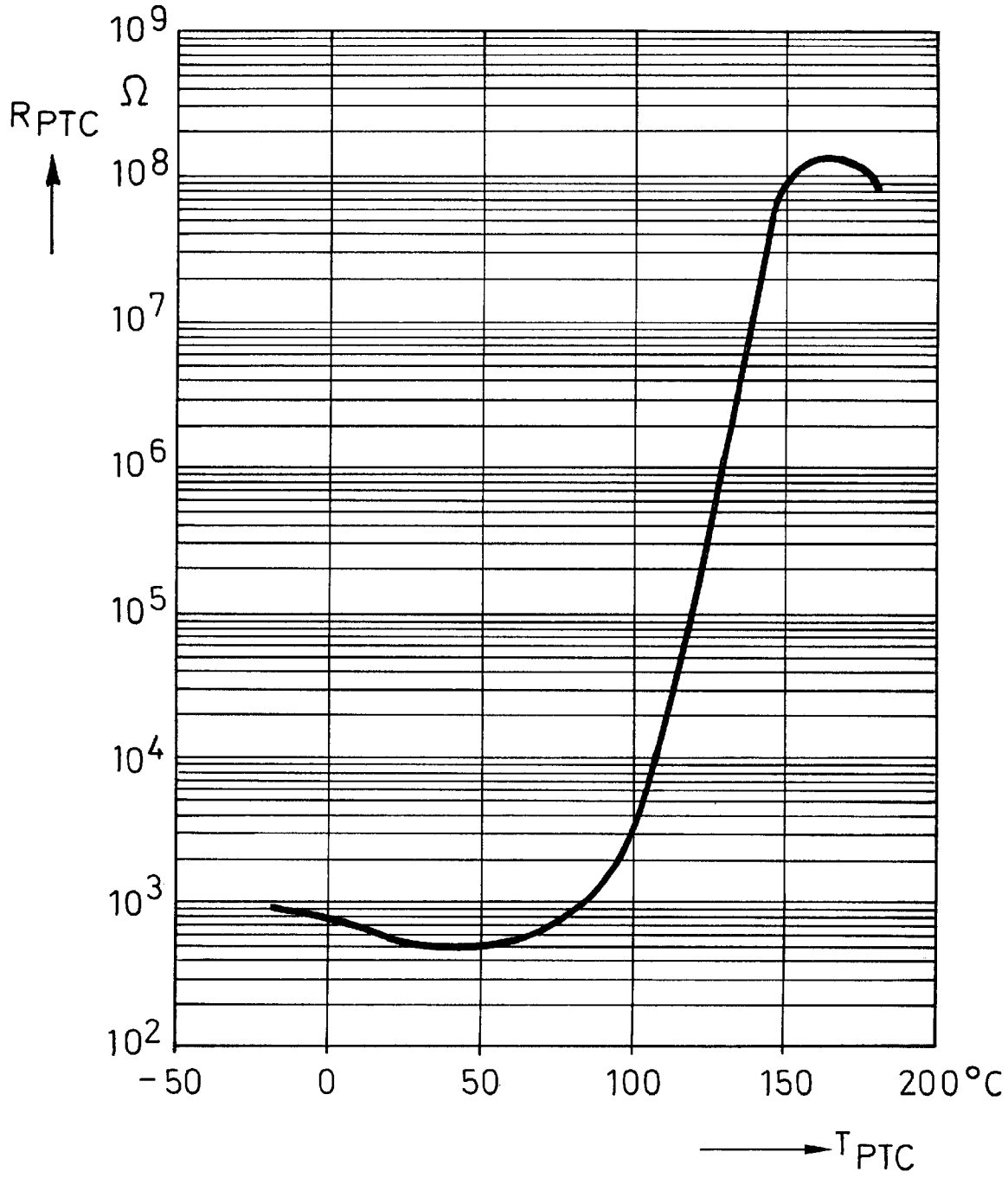
FIG. 9 is a diagram of the electrical resistance of a NTC heating element as a function of its temperature.

FIG. 9 shows how the electrical resistance R of a specific NTC heating element 19–24 increases at a certain temperature, here starting at about 90° C. As illustrated by this diagram, the electrical resistance R of the NTC heating element steadily increases from 103 WW starting at a temperature of about 90° C., and reaches a resistance of 108 WW at 150° C. As the resistance increases, the current flow, and hence the heat generation of the NTC heating elements 19–24, automatically decreases.

Since the DIN-EN 60335-2-66 dated February 1996 mentioned at the outset states that the temperature of the surface, here the metal plate 11, cannot exceed 150° C., the automatism of the NTC heating elements 19–24 yields an independent temperature limiting means that functions in each case and no longer depends on any control elements with a guaranteed safety.

Further, since the metal elements 15–18 consist either of aluminum or copper sections with a high mass, and hence have great heat storage capacity, not only is the stationary state for heat transmission in the metal plate 11 reached very quickly and uniformly, but a current flow is ensured at a low electrical resistance of the metal elements 15–18 as well, so that heat generation is left exclusively to the NTC heating elements 19–24.

The readily heat-conducting layer 27 between the bottom 11 a of the metal plate 11 and the NTC heating elements 19–24 and the metal elements 15–18 is provided with readily current-insulating properties, and advantageously consists of a permanently elastic heat conducting film filled with an acrylate adhesive. The permanent elasticity is here particularly important to prevent an embrittlement from creating an air gap that would impair heat transmission between the NTC heating elements 19–24 or metal elements 15–18 on the one hand and the bottom 11*a* of the metal plate 11 on the other.

The coupling elements 25, 26 designed as resilient contacting clamps each non-positively, conductively and positively couple two balanced metal elements 15–18 with the NTC heating elements 19–24 arranged in between. This eliminates the need for otherwise required adhesive layers and the associated problems of diminished current conduction owing to the electrical resistance of such adhesive layers. Since the resilient contacting clamps 25*a*, 25*b*; 26*a*, 26*b* of the coupling elements 25, 26 also are not exposed to any dynamic loads, a lasting durability is ensured.

Figure 11:
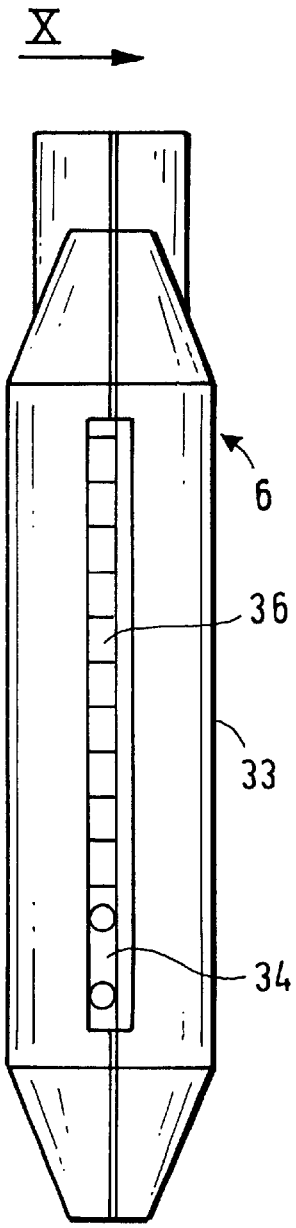
FIG. 11 is a side view in the direction of arrow XI on FIG. 10.
Figure 10:
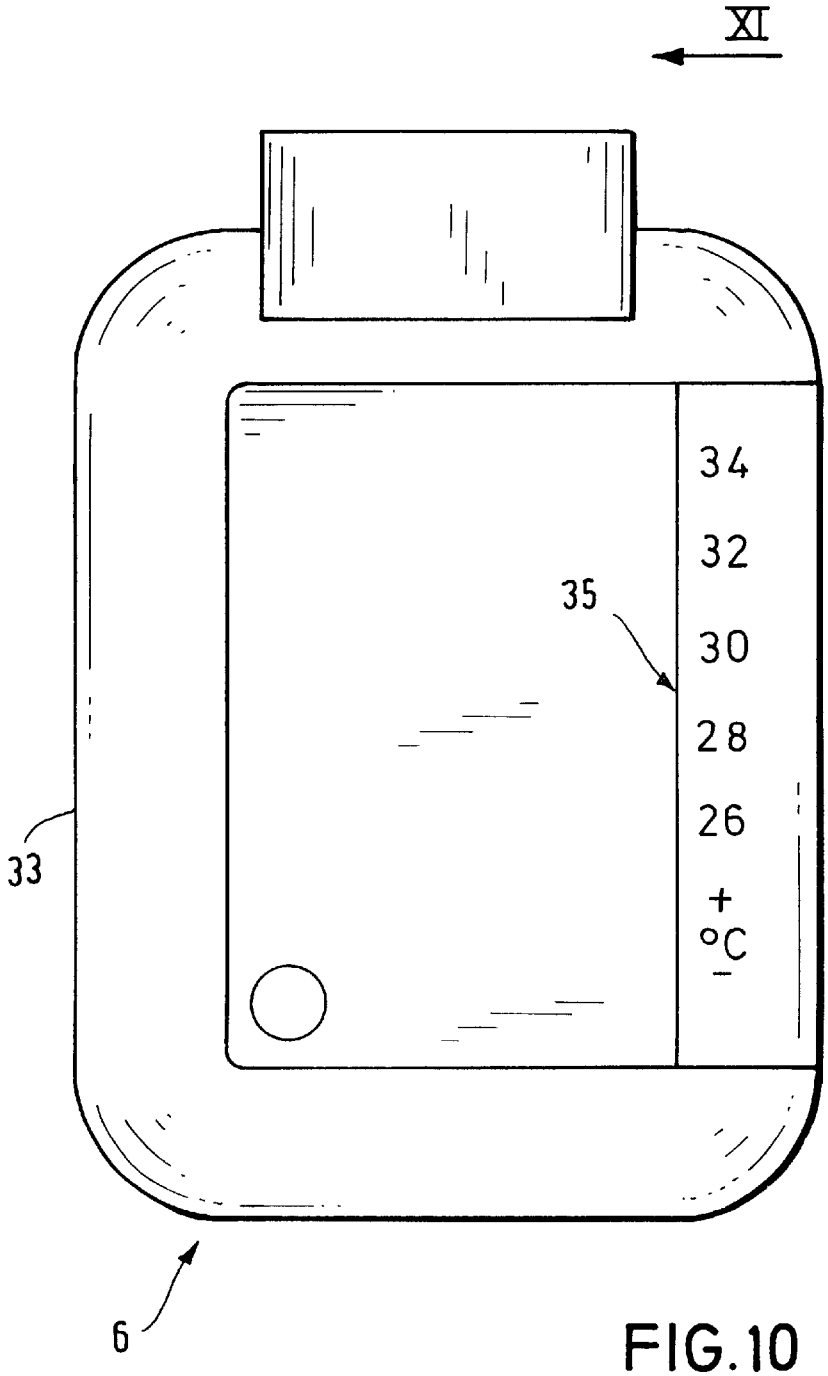
FIG. 10 is a view in the direction of the arrow X on FIG. 11, depicting a controller casing with microcomputer.

The first NTC sensor 12 (see FIG. 3) used for measuring the temperature of the waterbed core 9 and the second NTC sensor 13 used for measuring the temperature of the metal plate 11 are connected according to FIG. 10 and 11 with a microcomputer 33 located in the controller casing 6. This microcomputer 33 continuously evaluates both temperatures, and controls the temperature of the metal plate 11 in such a way that the water temperature of the waterbed core 9 rises to the desired temperature set on the controller casing 6. In this case, the microcomputer 33 also ensures that the surface temperature of the metal plate 11 is limited to 60° C. The respectively desired temperature can be set using a plus-minus switch 34 on the controller casing 6 to the corresponding temperature scale 35 via a continuous row of light-emitting diodes 36, and hence without using a previously common slider.

Given a failure of one or both of the two NTC sensors 12, 13 or a break in a line leading to them, this microcomputer 33 runs a plausibility check to preclude a malfunction, and limits both the temperature on the surface of the metal plate 11 and the temperature of the waterbed core 9.

In this case, the composition of the NTC elements 19–24 is such that, in the event of a malfunction, e.g., given a failure of the electronics or one of the two NTC sensors 12, 13, the increasing electrical resistance limits the temperature to under the maximal permissible temperature of 125° C. automatically starting at a specific temperature.

Since these NTC heating elements 19–24 consist of specific ceramic elements, this also provides a real ceramic waterbed heater for the first time.

What is claimed is:

1. Heater with electrical heating elements for waterbeds, which is arranged between a bed frame and a safety film, and which controls the temperature of a metal plate placed under the safety film of a waterbed core lying thereupon, wherein the heating elements are connected in a heat-conducting manner with the bottom side of the metal plate in a flat casing via a readily heat-conducting layer, characterized by the fact that the heating elements consist of several current and heat conducting metal elements (15–18) held together by current carrying coupling elements (25, 26), and NTC heating elements (19–24) clamped in between that generate heat when energized, and that the readly heat-conducting layer is formed between the bottom **(11*a*) of the metal plate (11) and heating elements (15–24) as a bilaterally adhesive film layer (27)** with good current insulating properties.

2. Heater according to claim 1, characterized by the fact that the metal elements (15–18) consist of aluminum or copper sections with a high mass, and hence great heat storage capacity.

3. Heater according to claim 1, characterized by the fact that the NTC heating elements (19–24) consist of barium carbonate, titanium oxide and other additives.

4. Heater according to claim 1, characterized by the fact that the film layer (27) consists of a permanently elastic heat conducting film filled with an acrylate adhesive.

5. Heater according to claim 1, characterized by the fact that the coupling element (25, 26) consists of a resilient contacting clamp, which non-positively, conductively and positively couples two balanced metal elements (15, 17; 16, 18) with the NTC heating elements (19–24) lying in between.

6. Heater according to claim 1, characterized by the fact that the side of the metal elements (15–18) facing away from the current-insulating and heat insulating film layer (27) are provided with dovetailed recesses (29) for the positive engagement of contacting clamps (25, 26).

7. Heater according to claim 1, characterized by the fact that several metal elements (15–18) with NTC heating elements (19–24) lying in between are arranged over nearly the entire surface of the metal plate (11).

8. Heater according to claim 1, characterized by the fact that it has a total of four parallel running metal elements (15–18) with a total of six NTC heating elements (19–24) lying in between, below the metal plate (11) and film layer (27).

9. Heater according to claim 1, characterized by the fact that the heater (1) is controlled by two NTC sensors (12, 13), of which a first (12) is situated outside the area of the metal plate (11) in an outside area **(14*a*) of the casing (14) in such a way as to be in direct measuring contact with the waterbed core (9), and a second (13) is arranged under the metal plate (11)**.

10. Heater according to claim 9, characterized by the fact that the first NTC sensor (12) used for measuring the temperature of the waterbed core (9) and the second NTC sensor (13) used for measuring the temperature of the metal plate (11) are connected with a microcomputer (33), which continuously evaluates both temperatures, and controls the temperature of the metal plate (11) in such a way that the water temperature of the waterbed core (9) rises to the desired temperature set on the controller casing (6).

11. Heater according to claim 10, characterized by the fact that the microcomputer (33) limits the surface temperature of the metal plate (11) to 60° C.

12. Heater according to claim 1, characterized by the fact that the composition of the NTC elements (19–24) is such that, in the event of a malfunction, e.g., given a failure of the electronics or one of the two NTC sensors (12, 13), the increasing electrical resistance automatically limits the temperature to under the maximal permissible temperature of 125° C.

13. Heater according to claim 10, characterized by the fact that, given a failure of an NTC sensor (12, 13) or a break in a line leading to them, the microcomputer (33) runs a plausibility check to preclude a malfunction, and limits both the temperature on the surface of the metal plate (11) and the temperature of the waterbed core (9).

14. Heater according to claim 10, characterized by the fact the microcomputer (33) and controller (6) are housed in a shared casing.

* * * * *